US005655234A

United States Patent [19]

Randleas

[11] Patent Number: 5,655,234

[45] Date of Patent: Aug. 12, 1997

[54] BUNK BED STRUCTURE WITH A VERTICAL MOVABLE BUNK

[76] Inventor: Steven C. Randleas, 723 N. 11th St., Coeur d'Alene, Id. 83814

[21] Appl. No.: 567,088

[22] Filed: Dec. 4, 1995

[51] Int. Cl.[6] ..... A47C 19/00; A47C 31/00

[52] U.S. Cl. ..... 5/9.1; 5/11

[58] Field of Search ..... 5/8, 9.1, 11, 10.2, 5/611

[56] References Cited

U.S. PATENT DOCUMENTS

| | | | |
|---|---|---|---|
| 826,332 | 7/1906 | Hayden . | |
| 872,498 | 12/1907 | Cleveland | 5/11 |
| 895,898 | 8/1908 | Scheer . | |
| 1,073,991 | 9/1913 | Jones | 5/11 |
| 1,341,441 | 5/1920 | Sagel . | |
| 2,774,976 | 12/1956 | Ross | 5/9.1 |
| 2,901,755 | 9/1959 | Wood | 5/11 |
| 3,028,606 | 4/1962 | Boutet | 5/9.1 |
| 3,735,979 | 5/1973 | Levenberg | 5/8 |
| 4,378,128 | 3/1983 | Holling et al. . | |
| 5,150,980 | 9/1992 | Lin . | |

FOREIGN PATENT DOCUMENTS

| | | | |
|---|---|---|---|
| 19225 | 9/1898 | United Kingdom | 5/11 |

*Primary Examiner*—Flemming Saether
*Attorney, Agent, or Firm*—Keith S. Bergman

[57] ABSTRACT

A bunk bed structure having a vertically movable upper bunk provides a main frame having two spaced corner posts at each end interconnected by end cross pieces in their upper extensions, with a side support interconnecting the upper portions of each end post on one side of the main frame. A lower bunk frame having a depending medial portion to support a bed board and bedding is carried by four tubular corner collars on the lower portions of each of the corner posts. A similar upper bunk frame is slidably carried by four tubular corner collars on the corner posts for vertical motion above the lower bunk frame. Each upper bunk corner collar has associated fastening pins that releasably fasten and positionally maintain the collar on its associated corner post. The bunk structure frames are formed of tubular pipe elements interconnected by fixtures commonly used to join such elements and the pipe elements, especially if formed of plastic, may carry more rigid rods or tubes in their medial channels to increase strength and rigidity.

5 Claims, 3 Drawing Sheets

BUNK BED STRUCTURE WITH A VERTICAL MOVABLE BUNK

BACKGROUND OF INVENTION

1. Related Applications

There are no applications related hereto heretofore filed in this or any foreign country.

2. Field of Invention

This invention relates generally to human beds, and more particularly to stacked bunk beds having an upper bunk vertically movable relative to a lower bunk.

BACKGROUND AND DESCRIPTION OF PRIOR ART

Various nested and other associative arrays of two or more beds have long been known and have become and remain popular, especially where space for such facilities may be limited or where various of the associated bed members may not often be used. The so-called "bunk bed" having two or more bed members in spaced vertical array has become especially popular because the multiple beds occupy only the same floor space as otherwise would be occupied by the lowermost bed, and normally in most bed containing enclosures floor space is more crowded and less available than vertical space above it. Many and various bunk bed structures have heretofore become known and during the course of their historical development these structures have become increasingly sophisticated, but yet have not solved all of the problems that persist in such structures. The instant bunk bed seeks to solve or minimize still existent problems and in so do provides a new and novel structure.

Since beds generally are used only during limited periods of time, it normally is of more utility and more desirable if they may be easily reduced in bulk during periods of non-use so that the space that commonly would be occupied during non-use periods may be otherwise used. This feature becomes even more desirable in multiple bed structures if the beds other than the primary bed are used only occasionally at spaced intervals. The instant bunk bed structure allows accomplishments of this function by providing a main frame having corner posts fixedly carrying a lower bunk and slidably carrying an adjustably positionable upper bunk thereabove. The upper bunk may be positioned spacedly upwardly from the lower bunk for use as an ordinary bunk bed, but during periods of non-use it may be lowered to a position closely upwardly adjacent the lower bunk so that the bed structure has substantially no more vertical height than the vertical height of an ordinary bed structure, while yet providing a free-standing main frame that may be positioned anywhere on a supporting floor without reference to vertical walls.

Bunk beds having at least one upper bunk vertically movable relative to a lower bunk have heretofore become known, though such structures have not become particularly popular in the present day marketplace probably because they have not effectively resolved or dealt with the inherent problems associated with such structures. If a releasably positionable upper bunk is to be used, it must firstly be simply and easily movable and positionally maintainable where desired and secondly, it must be positionable in both raised and lowered modes with substantial security and reliability to effectively fulfill the requirements of the normal cultural uses of bed structures. My bunk bed structure addresses these problems by providing means for fastening each of four upper bunk collars on the associated corner posts that include two vertically spaced pins that extend through the collar and associated corner post to provide the security of double pin fastening while yet mounting the two pins in a spring-biased fastening element that is slidably carried between two end crosspieces so that both pins may be simultaneously moved for fastening and unfastening. Additionally, the pin fastening element is itself releasably fastened to an end crosspiece to prevent accidental release of the fastening pins from their fastening position.

To make a bunk bed structure economically feasible it must be of such simple and economic construction that it can compete in the marketplace with existing bunk bed structures and yet it must be of sufficient durability and rigidity as to allow normal usage over substantial periods of time. To accomplish these ends, I provide a frame construction with tubular elements that are joined by pipe-like fittings which may be interconnected to the tubular frame elements by adhesion, mechanical fasteners or both to provide joints substantially as strong as the tubular elements themselves. Additional rigidity is provided by establishing solid, more rigid rods or tubes within the channels defined by linear frame element so that each frame element individually acts as a compound beam and the sub-structures formed by groups of frame elements create compound beam configurations. Prior bunk bed structures that have been formed of tubular elements have not provided strengthening elements in the tubular channels and by reason of this have either not provided the structural strength or rigidity of my bunk bed structure or if they have done so not as economically as my structure.

My invention lies not in any one of these features individually, but rather in the synergistic combination of all of the structures of my bed that necessarily gives rise to the functions flowing therefrom as specified and claimed herein.

SUMMARY OF INVENTION

My bunk bed provides a main frame formed by similar U-shaped ends each having spaced vertical corner posts interconnected in their upper ends by an end crosspiece, with an upper side support connecting the upper portions of two corner posts on the same side of the frame. A lower bunk frame having four vertical tubular collars spaced to fit on the corner posts and interconnected by two vertically spaced crosspieces at each end and one crosspiece on each side is fixedly carried on the lower portions of the corner posts. The lower bunk structure has a plurality of U-shaped bed support elements extending between the opposed side crosspieces to define a depending medial area to support a bedding support and bedding. A similar upper bunk frame having four tubular corner collars defining channels to slidably fit on the corner posts provides two vertically spaced end crosspieces and single side crosspieces extending therebetween. The opposed side crosspieces carry depending U-shaped bed supports to support a bedding support and bedding. The main frame is formed of tubular elements having end portions interconnected by tubular fittings and carrying rigid rods in their central channels to provide additional strength and rigidity.

Each pair of upper bunk end crosspieces carry fastening structure in their lateral portions, including two vertically spaced fastening pins extendable through cooperating pairs of spaced holes defined in the associated collar and end post to receive the pins to releasably fasten those elements relative to each other. The fastening pins are carried by fastening supports that move against spring-bias to release the interconnection to allow vertical motion of the upper bunk frame on the corner posts. Fastening means are provided on the upper bunk end crosspieces to maintain the fastening supports in fastening mode.

In creating such a structure, it is:

A principal object to provide a bunk bed with a main frame fixedly supporting a lower bunk bed frame and slidably supporting an upper bunk bed frame for releasable vertical positioning spacedly above the lower bunk bed frame.

A further object is to provide such a bunk bed wherein the upper bunk frame has four vertical tubular corner collars slidably carried on the main frame corner posts with a set of two vertically spaced pins extending in cooperating holes through each set of associated corner collars and corner posts to assure strong and dependable fastening of the interconnected elements relative to each other.

A further object is to provide such a bunk bed wherein each set of fastening pins are biased to a laterally outward fastening position, but simultaneously movable against their bias by an interconnecting fastening support which may be fastened on the upper bunk end crosspieces to prevent motion of the fastening pins to safely secure the vertical positioning of the upper bunk frame.

A further object is to provide such a bunk bed that is formed of tubular elements structurally interconnected by tubular fixtures to provide substantial strength and rigidity.

A still further object is to provide such tubular elements wherein the internal channels of linear elements carry rods or tubes to add additional strength and rigidity.

A still further object is to provide such bunk bed frames that have a plurality of parallel spaced U-shaped bed supports depending therefrom to support bedding below the bunk bed peripheral frame elements to secure positional maintenance of the bedding.

A still further object is to provide such a bunk bed that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement, with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF PREFERRED EMBODIMENT

Figure 1:
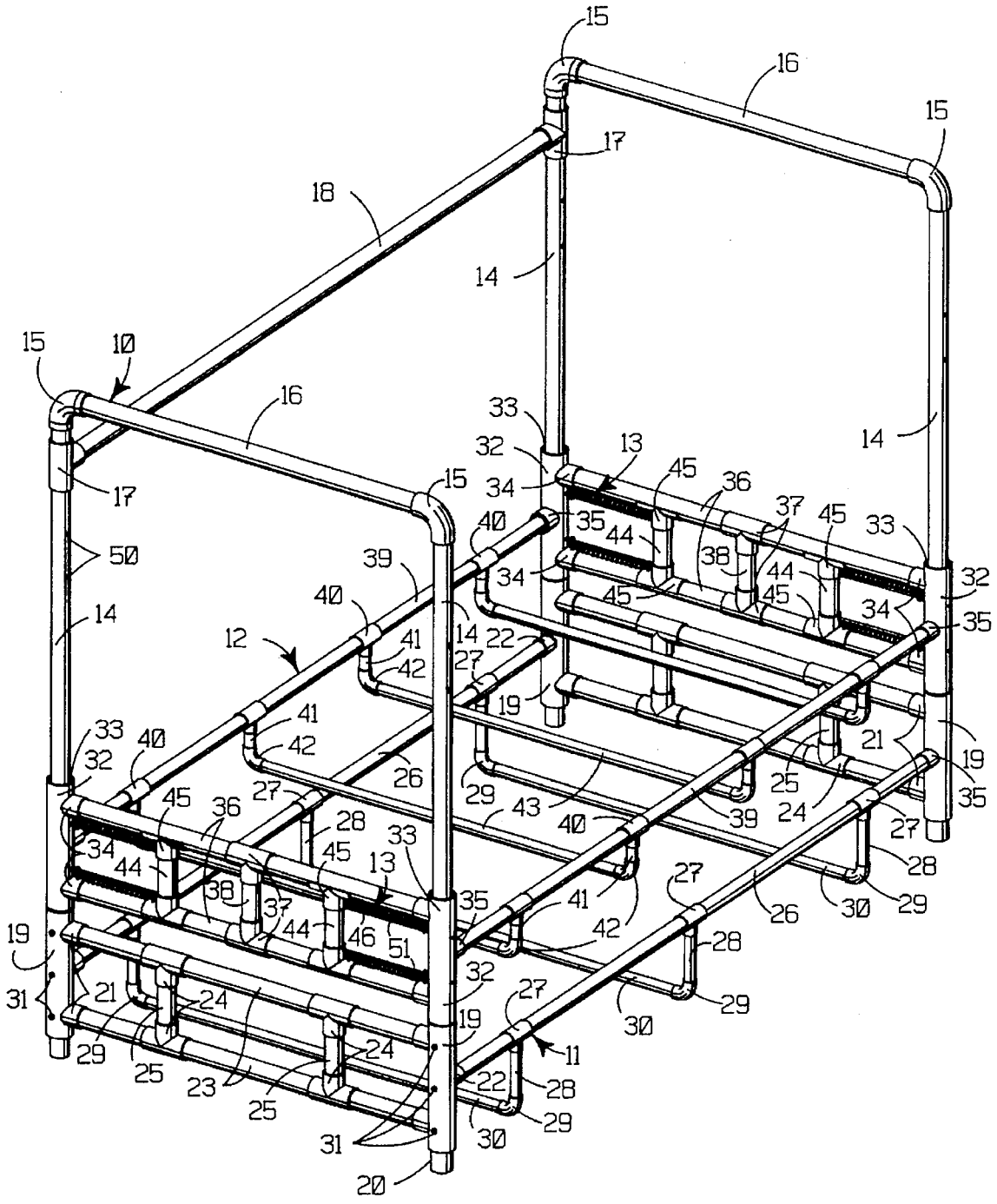
FIG. 1 is an isometric surface view of my bunk bed structure showing its various parts, their configuration and relationship.
Figure 3:
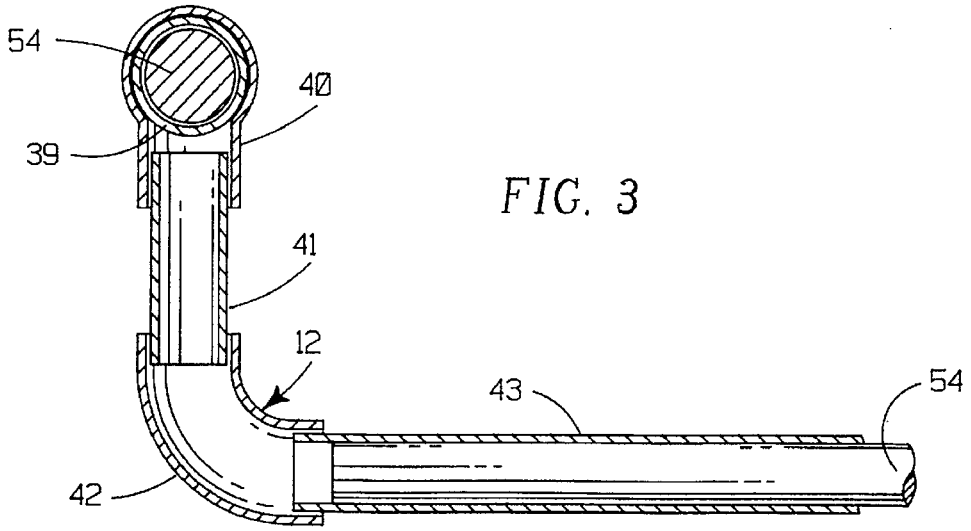
FIG. 3 is an enlarged vertical cross-sectional view through the interconnection of a bedding support crosspiece with the side crosspiece of the upper bunk frame, taken on the line 3—3 on FIG. 2 in the direction indicated by the arrows thereon.

Referring to the drawings in greater detail, it is seen that my bunk bed structure generally comprises main frame 10 fixedly supporting lower bunk frame 11 and movably supporting upper bunk frame 12, with fastening structure 13 communicating between the upper bunk frame and main frame.

Main frame 10 provides similar ends formed by spaced vertical corner posts 14, each carrying in its upper end similar inwardly extending elbows 15 joining end crosspiece 16 to form the U-shaped structure illustrated. Two vertical corner posts on the same side of the ends carry "T" connectors 17 immediately below the elbows 15 so orientated that the base of each of these "T" connectors interconnects side crosspiece 18 to interconnect the upper portions of the frame ends. The length of end crosspieces 16 is incrementally greater than the width desired for a particular bunk bed and the length of side crosspiece 18 is incrementally greater than the length desired for the bed.

Lower bunk frame 11 provides four similar tubular corner post collars 19, each defining internal channel 20 incrementally larger than the external diameter of the associated vertical corner post 14 so that a vertical corner post may be structurally carried therein. The corner post collars 19 each carry vertically spaced tubular upper and lower laterally inwardly extending nipples 21 and medial nipple 23 extending in an elongate direction to interconnect crosspieces. The nipples 21 on each set of corner post collars carry similar end crosspieces 23 in a vertically spaced relationship. These crosspieces are interconnected in spaced medial portions by paired opposed tubular "T" connectors 24 each joined by vertical crosspiece 25. The medial nipples 22 on each side of the lower bunk frame carry elongate side crosspiece 28 fastenably extending therebetween. The crosspieces are of such length that when assembled with the corner collars, those collars are arrayed to fit upon the four corner posts 14.

Each of the side crosspieces 28 carry a plurality of spaced paired opposed tubular "T" connectors 27, with the body arms extending downwardly to each interconnect depending vertical bed support tube 28. The lower portion of each vertical bed support tube 28 carries right angled tubular elbow 29 oriented with its lower portion extending laterally inwardly toward the corresponding elbow on the support tube carried by the opposite side crosspiece. A plurality of horizontal bed support tubes 30 are carried between each opposed cooperating pair of elbows 29 to form a support structure for bedding elements that depends below the side crosspieces supporting the bedding support elements.

The lower bunk frame 11 may be either permanently or releasably joined to the lower portion of the vertical corner posts 14 of the main frame as desired in a particular bunk bed design. If permanent joiner is desired, it preferably is accomplished by adhesion or adhesion combined with mechanical fastening. If releasable fastening is desired, preferably it will be accomplished by mechanical fasteners 30 such as bolts or screws extending through appropriately positioned pairs of holes defined in the corner post collars 19 and associated corner posts 14 to maintain the positional relationship between these elements. Normally the various elements of the lower bunk frame are permanently interconnected to provide greater strength and rigidity for the entire structure than would exist if the elements were not so interconnected.

Upper bunk frame 12 is of similar construction and configuration to the lower bunk frame. The upper bunk frame provides corner post collars 32 defining internal channels 33 incrementally larger than the diameter of the associated vertical corner post to allow a sliding motion of the collar on that corner post. The corner post collars 32 provide vertically spaced upper and lower, laterally inwardly extending tubular nipples 34 and medial inwardly elongate facing tubular nipples 35 to interconnect end crosspieces and side crosspieces respectively. Vertically spaced end crosspieces 36 extend between each opposed cooperating pair of upper and lower nipples 34 and are structurally interconnected therein. Paired opposed, medially positioned tubular "T" connectors 37 are carried by each end crosspiece 36 for interconnection by vertical end crosspiece support tube 38. Elongate side crosspiece 39 extends between paired opposed medial nipples 35 on each side of the upper frame. The crosspieces are of such length that, when the upper bunk frame is assembled, the corner collars may be slidably carried on the main frame corner posts.

Each side crosspiece 39 carries a plurality of paired opposed T-shaped tube connectors 40, each with downwardly extending body arm carrying a vertically depending bed support tube 41. The lower ends of the bed support tubes 41 each carry a right angle elbow 42 oriented with its lower arm extending laterally inwardly to carry a horizontal bed support tube 43 between each opposed pair of elbows 42.

The various elements of the upper bunk frame may be joined with each other in a permanent or releasable manner, but preferably for structural rigidity and durability they are permanently joined. The corner post collars are slidably maintained on the vertical corner posts and are not permanently interconnected with the corner posts.

Figure 4:
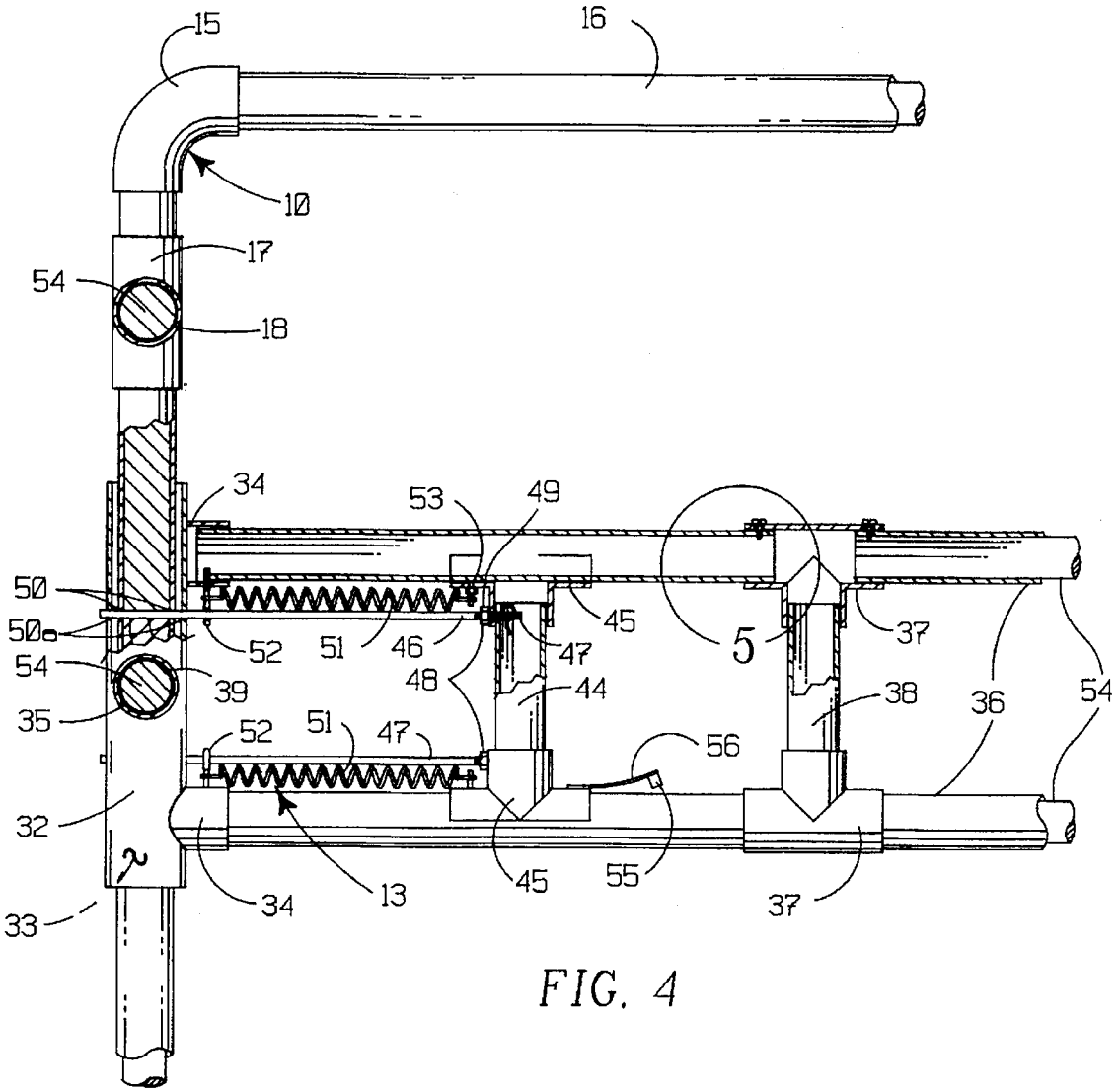
FIG. 4 is an orthographic, partially cut away view of the end structure of FIG. 2 showing details of the interconnection and fastening of the lateral portion of the upper bunk frame on the associated corner post.
Figure 5:
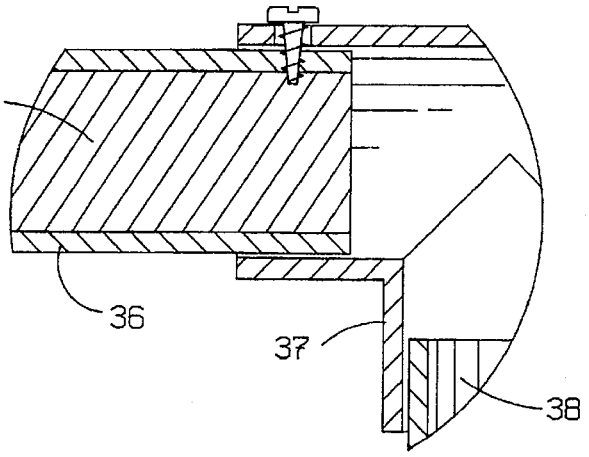
FIG. 5 is an enlarged view of the portion of FIG. 4 within the circle 5 thereon to show the mechanical fastening of interconnected frame elements.
Figure 2:
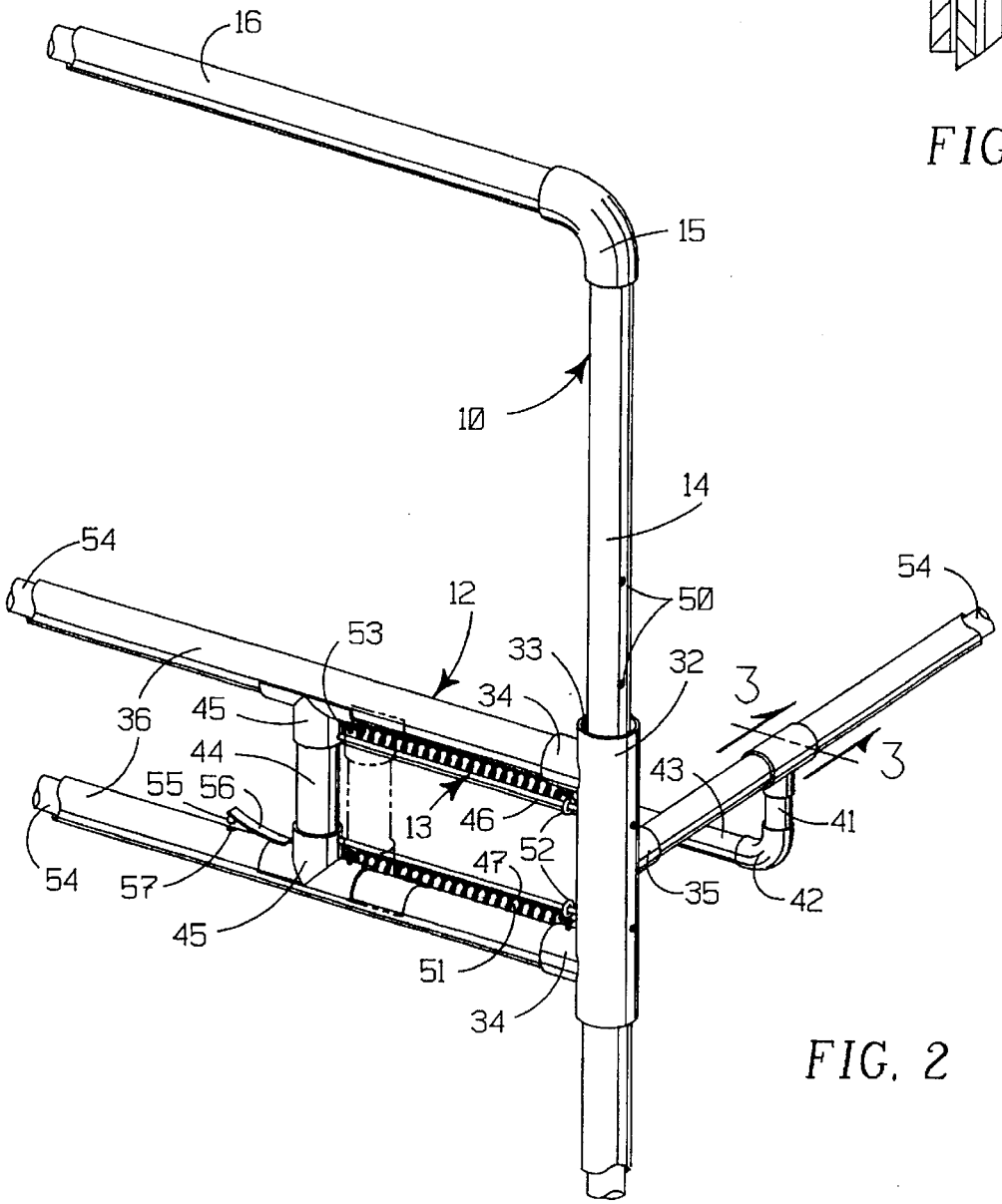
FIG. 2 is an enlarged partial isometric view of the fastening structure in a lateral corner portion of the upper bunk frame.

Fastening structure 13, seen particularly in FIG. 4, is associated with the interconnection of each lateral end portion of each upper bunk frame with its associated vertical corner post. The fastening structure provides fastening post 44 slidably maintained in vertical orientation between upper and lower end crosspieces 36 by "T" type connectors 45, in the instance illustrated having a half cylindrical arm portion adjacent each end crosspiece. The spacing between the "T" connectors 45 is such that the fastening post structure is slidable in a lateral direction between the end crosspieces.

Each fastening post 44 carries vertically spaced upper fastening pin 46 and lower fastening pin 47 extending substantially parallel to the end crosspieces 36 and positioned spacedly inwardly therefrom. The inner end portions of the fastening pins extend through appropriately positioned paired cooperating holes 48 defined through both fastening posts 44 and the bodies of "T" connectors 45 so that the inner end portion 47 of the pins may be positionally maintained in those holes by fasteners 49 carried in the channels of the fastening posts 44. The fastening pins are of sufficient length that their laterally outer end portions extend through paired opposed cooperating holes 50 defined in the adjacent corner post and aligned cooperating holes **50*a* defined in the collar 32** carrying that post.

Extension spring 51 communicates from vertically extending eye bolt 52 carried by upper and lower nipples 34 to vertically extending pins 53 carried by the arm of "T" connector 45 to bias the fastening pins 46, 47 laterally outwardly through cooperating holes 50, **50*a*, but allow inward movement of the fastening post 44 against the spring bias to remove the fastening pins from the holes 50, 50*a*, so that the corner post collars may be moved vertically relative to the corner posts carrying them. The eye bolt 52 also serves as a guide for the laterally outer portions of fastening pins 46 to maintain the pins in proper alignment relative to the holes 50, 50*a*. A pair of spacedly adjacent holes 50*a* are defined in the corner post collar 32** associated with each fastening structure to receive the associated fastening pins.

Leaf spring 56 having security pin 55 in its outer end portion is carried by one "T" connector 45 of each associated pair of "T" connectors so that the security pin may be engaged in hole 57 defined in the adjacent end crosspiece to secure the fastened position of fastening pins 46, but yet allow release by appropriate manipulation when desired for fastening pin repositioning. At least two vertically spaced sets of holes 50, **50*a*** are defined in similar positions in each vertical corner post to accommodate the upper bed frame in lowered and raised positions, and other spacedly adjacent sets of holes (not shown) may be provided to allow adjustable vertical positioning of the upper bunk frame at various intermediate vertical positions.

Each of the lineally elongate portions of the tubular elements of my bunk bed structure may carry rigid stiffening elements 54 for additional strength and rigidity. Preferably the stiffening elements 54 are formed of wood rods, though they may be formed from other similar material or even from tubular polymeric materials and all such materials are within the ambit and scope of my invention. Normally, the curvilinear elbows will not be so reinforced as such reinforcement ordinarily is not necessary by reason of the particular configuration and size of the elbows, but if desired those elements also my be reinforced with material in their channels such as settable filler or appropriately shaped rigid material and such reinforcement also is within the ambit of my invention.

The various fixtures interconnecting frame posts and crosspieces are illustrated as defining channels larger than the interconnected elements so as to fit thereover, but such fixtures that fit within channels defined by interconnected elements are essentially equivalent and within the scope of my invention as is a fixtureless interconnection such as welding, adhesion and the like.

Preferably the tubular elements of my bunk bed structure will be formed of harder, more dense polymeric or resinous plastic materials, though they may be formed from metallic tubular or other similar elongate material having appropriate strength, rigidity and durability. The particular tubular elements illustrated are round, but this cross-sectional shape is not necessary or essential and other tubes of different cross-sectional shape may be used in my bunk bed structure with appropriately shaped cooperating connectors.

Having described the structure of my bunk bed, its operation may be understood.

Firstly, a bunk bed structure is constructed according to the foregoing specification. The size and configuration of the structure is not critical, but normally these parameters are so determined that the completed structure will accept bedding components of common commercially available sizes. Usually with most bunk beds, it is desired that they accept such components of the so called "single bed" size. The strength and rigidity of the components of the structure must be related to bed size, so that the components may provide the support that is required to allow the normal usage as a bed. The size and configurational parameters of the bed structure and their relationship to its structural elements can readily be determined by known engineering methods.

Once the bed structure is formed, it is provided with ordinary bedding (not shown). Commonly, some rigid supportative member such as a sheet of plywood or some similar rigid sheet material of appropriate size will be placed on top of the horizontal bed support tubes, and this sheet in turn will support a mattress, springs or both as desired with the normal bedding clothes carried thereabove.

To move the upper bunk frame from a lower position, as illustrated in FIG. 1, to a raised position as shown in FIG. 4, it is convenient to have the assistance of two persons, one at each end structure. Each person simultaneously moves each of the paired vertical fastening posts 44 inwardly toward the medial vertical post 38 to move the paired fastening pins 46, 47 laterally inwardly and out of positioning within the holes 50, 50*a*. While maintaining the fastening structures in this position, the upper bunk frame is manually manipulated to move it vertically to the desired upward position and the upper set of holes 50 defined in the corner posts are aligned with the set of holes 50*a* defined in the corner collars 32. The vertical fastening posts 44 then are allowed to move laterally outwardly by reason of their spring bias, or as aided by manual manipulation of an operator, so that the fastening pins 46, 47 move laterally outwardly, into and through the pairs of cooperating holes 50*a* defined in the corner post collars. The structure then is in fastened condition, and the security pin 55 carried by "T" connector 45 is moved into its associated hole 57 in the end crosspiece to maintain the fastening posts and consequently the fastening pins in fastening mode.

The operation described is merely reversed to move the upper bunk structure from its upper position to its lower storage position adjacent the lower bunk frame 11.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A bunk bed structure having an upper bunk vertically movable relative to a lower bunk, comprising in combination:

a rectilinear main frame having two similar spaced ends and two sides, each end formed by vertical corner posts joined at their upper ends by end crosspieces, and both said ends joined by a side crosspiece extending between upper portions of two vertical corner posts on the same side of the ends;

a lower bunk frame carried on the corner posts of the main frame and having four vertically oriented lower bunk corner post collars, each defining a medial channel to receive one of said corner posts, with at least one lower bunk end crosspiece extending between each pair of end lower bunk corner post collars, at least one lower bunk side crosspiece extending between each pair of lower bunk end corner post collars on the same side of the frame, and a plurality of spaced horizontal lower bunk bed support tubes depending below and structurally communicating between the lower bunk side crosspieces;

an upper bunk frame slidably carried on the corner posts of the main frame above the lower bunk frame and having four vertically oriented upper bunk corner post collars each defining a medial channel to receive one of said corner posts, with two vertical spaced upper bunk crosspieces extending between each pair of end upper bunk corner collars, an upper bunk side crosspiece extending between each pair of end upper bunk corner collars on the same side of the frame, and a plurality of spaced horizontal upper bunk bed support tubes depending below and structurally communicating between the side upper bunk crosspieces; and fastening structure carried by each lateral portion of each pair of end upper bunk crosspieces, each fastening structure having a vertical fastening post slidably carried between the end upper bunk crosspieces and supporting two vertically spaced elongate fastening pins extending laterally outwardly and through spaced pairs of cooperating holes defined in both the adjacent upper bunk corner post collar and the corner post carried therein, said vertical fastening post being biased to a laterally outward position but manually movable against its bias to move the fastening pins from the said spaced pairs of cooperating holes defined in the adjacent upper bunk corner post collar.

2. The bunk bed structure of claim 1 wherein the main frame and bunk frames are formed of tubular elements each defining medial channels having lineal portions carrying rigid stiffening elements in the medial channels to provide additional strength and rigidity.

3. The bunk bed structure of claim 1 formed of circular cylindrical tubular elements interconnected by mechanically joined intercommunicating tubular joining fixtures.

4. The bunk bed structure of claim 1 wherein each vertical fastening post is releasably fastenable on at least one adjacent upper bunk end crosspiece of the upper bunk frame to secure the fastenable positioning of the fastening pins carried by said fastening post.

5. The bunk bed structure of claim 1 wherein each vertical end post defines at least one pair of spaced fastening pin holes in a position to maintain the upper bunk frame immediately upwardly adjacent the lower bunk frame and at least one pair of spaced fastening pin holes in a position to maintain the upper bunk structure on an upper portion of the corner posts spacedly above the lower bunk frame.

* * * * *